US006213017B1

(12) United States Patent
Schäfer et al.

(10) Patent No.: US 6,213,017 B1
(45) Date of Patent: Apr. 10, 2001

(54) INK DUCT PIVOTABLE BETWEEN TWO POSITIONS

(75) Inventors: Karl Robert Schäfer, Rimpar; Georg Schneider, Würzburg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/269,770

(22) PCT Filed: Oct. 17, 1997

(86) PCT No.: PCT/DE97/02396

§ 371 Date: Apr. 26, 1999

§ 102(e) Date: Apr. 26, 1999

(87) PCT Pub. No.: WO98/18630

PCT Pub. Date: May 7, 1998

(30) Foreign Application Priority Data

Oct. 25, 1996 (DE) ..... 196 44 369

(51) Int. Cl.[7] ..... B41F 31/00

(52) U.S. Cl. ..... 101/352.01; 101/352.04; 101/351.3

(58) Field of Search ..... 101/202, 326, 101/205–210, 348, 349.1, 350.1, 351.1–351.4, 364, 367, 352.01–352.05

(56) References Cited

U.S. PATENT DOCUMENTS

| | | | | |
|---|---|---|---|---|
| 1,441,808 | * | 1/1923 | Jewell et al. . | |
| 1,463,562 | * | 7/1923 | Stevens et al. . | |
| 2,377,110 | * | 5/1945 | Smith | 101/157 |
| 3,521,559 | * | 7/1970 | Sejeck et al. | 101/137 |
| 3,566,787 | * | 3/1971 | Moos | 101/363 |
| 5,020,432 | | 6/1991 | Jeschke . | |
| 5,184,556 | | 2/1993 | Schaeuble . | |
| 5,406,887 | * | 4/1995 | Hertel et al. | 101/366 |
| 5,558,021 | * | 9/1996 | Erhard et al. | 101/232 |
| 5,560,294 | * | 10/1996 | Anders et al. | 101/366 |

FOREIGN PATENT DOCUMENTS

| | | |
|---|---|---|
| 29518278U1 | 2/1996 | (DE) . |
| 0180075 B1 | 10/1985 | (EP) . |
| 0556460 A1 | 8/1993 | (EP) . |
| WO 96/04140 | 2/1996 | (WO) . |

* cited by examiner

*Primary Examiner*—Kimberly L. Asher
(74) *Attorney, Agent, or Firm*—Jones, Tullar & Cooper, PC

(57) ABSTRACT

An ink duct is used with an ink-metering roller of a printing press. The ink duct includes doctor blades and is shiftable for pivoted movement between a working position and an emptying position with at least one of the doctor blades remaining in contact with the ink-metering roller. When the ink duct is in the emptying position, any printing ink in the ink duct is collected in a very low ink collection channel.

17 Claims, 2 Drawing Sheets

INK DUCT PIVOTABLE BETWEEN TWO POSITIONS

FIELD OF THE INVENTION

The present invention relates to an ink duct for an ink unit of a rotary printing press. The ink duct includes ink metering elements and can be shifted between at least two separate positions.

DESCRIPTION OF THE PRIOR ART

U.S. Pat. No. 5,184,556 describes a pivotable doctor blade.

SUMMARY OF THE INVENTION

The object of the present invention is directed to creating an ink duct which is easy to clean.

This object is attained in accordance with the invention by providing an ink duct with two arrangements of ink metering elements, such as doctor blades. The ink duct is pivotable about an ink metering roller with which it works between a working position and an ink draining position. During shifting, the ink metering elements remain in contact with the ink metering roller.

The advantages which can be achieved by the present invention lie, in particular, in that the ink duct, which is arranged on the ink metering roller, can be effortlessly pivoted from a working position into a draining position and back. For example, for changing doctor blades, the ink duct can be brought from the working position into the draining position and thereafter into a cleaning position, in which the ink duct is moved away from the ink metering roller, without ink running out of the ink duct.

Because the ink duct can be easily taken out of the printer in its draining position, both the ink duct as well as the metering elements fastened on the ink duct can be easily cleaned. Moreover, the ink roller itself is accessible.

BRIEF DESCRIPTION OF THE DRAWINGS

A preferred embodiment of the present invention is represented in the drawings and will be described in greater detail in what follows. Shown are in.

DESCRIPTION OF THE PREFERRED EMBODIMENT

Figure 1:
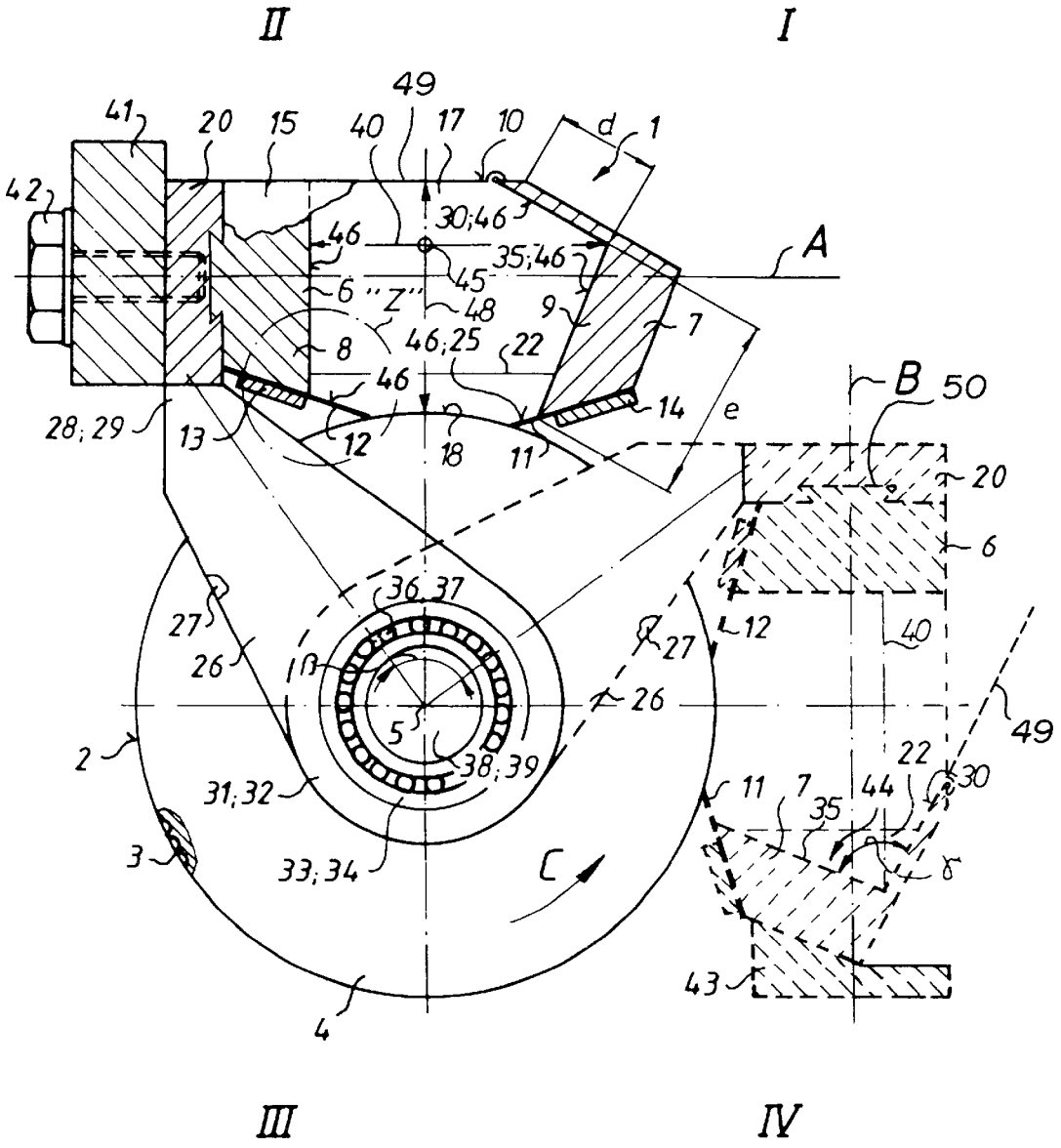
FIG. 1, a schematic representation of a cross section through an ink duct arranged above a screen roller in the working position and in dashed lines to the side of the screen roller in a resting position and with doctor blades; and in FIG. 2, an enlarged schematic representation of a detail "Z" from FIG. 1.

A pivotable ink duct 1 in accordance with the present invention has two oppositely located arrangements of ink metering elements, for example doctor blades, a row of working doctor blades 12 and a row of closing doctor blades 11. In its working position A as seen in FIG. 1, the ink duct is arranged in the upper area of an ink metering roller 4. The ink metering roller 4 has little cups 3 or depressions in its surface 2 and is thus typically identified as a screen roller or a screen surface roller.

Viewed in the production direction C, the closing doctor blade 11 has been positively placed against the ink metering roller 4.

Viewed in the production direction C, the working doctor blade 12 has been negatively placed against the ink metering roller 4 at a negative angle with respect to a line 16 tangent to the surface 2 of the roller 4 at the contact point between the closing doctor blade 11 and the roller 4.

The ink duct 1 includes a left lateral wall 6, and a right lateral wall 7, which walls 6 and 7 extend in an axis-parallel direction in respect to the ink metering roller 4 and which are spaced apart from each other. Depending on the intended pivot direction, the left, 6, and/or the right lateral wall 7 is angled toward the interior at a sufficient height and extending over the entire width of the ink duct 1.

Each of the right/left lateral walls 7, 6 extends downward from its upper edge 10, so that the inside width of the ink duct 1 increases, approximately to half the height of the ink duct 1 generally at the position of the transverse axis 40 of the ink duct 1, and thereafter narrows again in the portion located underneath. This means that one of the lateral walls 7, 6 is angled in such a way that an opening angle $\gamma$ of approximately 90° is opened between the upper partial lateral wall 30 and the lower partial lateral wall 35 of the right lateral wall 7, as seen in FIG. 1. In this case, the width d of the upper partial lateral wall 30 can be equal to the width e of the lower partial lateral wall 35. However, d can also be greater than e and vice versa. A longitudinal axis of the ink duct 1 is identified by 45 and a vertical axis of the ink duct 1 by 48. By means of this, a channel 44 is formed at the lowest point in the draining position B of the ink duct 1 as shown in dashed lines in FIG. 1, into which the ink 22 runs and into which the ink 22 is received. The lateral walls 6, 7 extend, when the ink duct is in its working position A, from an upper edge 10 downwardly in the direction toward their lower doctor blade mounting surface 8, 9 facing the ink metering roller 4. On these mounting surfaces 8, 9, the doctor blades 11, 12 are held by means of clamping strips 13, or respectively 14.

End walls 15, 17 have been attached to both sides of the ends of the lateral walls 6, 7. The lower side 18 of each end wall 15, 17 facing the ink metering roller 4 has been matched to the contour of the surface 2 of the ink metering roller 4. In its draining position B, the ink duct 1, viewed in its work position A, is open at the top.

The ink duct 1 can be fastened on a cross bar 20, for example by means of its lateral wall 6, on the lateral frames of the press. It is moreover possible to embody the ink duct 1 closed on the top, i.e. on its upper edge 10. One suitable top 49 is shown in FIG. 1. Top 49 can be supported for movement between closed and opened positions, as is also illustrated in FIG. 1.

In a further preferred embodiment, both ends of the cross bar 20 of the ink duct 1 are fastened on each one of the ends 28, or respectively 29, of a pivot arm 26, or respectively 27. The second ends 31, 32 of the pivot arms 26, 27 are each pivotably seated on a bearing bush 33, 34, fixed on the lateral frames. Via a rolling bearing 36, 37, each bearing bush 33, 34 receives an axle journal 38, 39 of the ink metering roller 4. By means of the steps just described, the ink duct 1 can be pivoted around the axis of rotation 5 of the ink metering roller 4.

In its top, or respectively work position A, the ink duct 1 is moved directly or indirectly into contact against a stop 41 fixed in place on the lateral frames by means of the cross bar 20 fastened on the pivot arms 26, 27, and is locked or fixed in place against stop 41 by means of screws 42. After unlocking, the horizontal ink duct 1 can be laterally pivoted from its work position A on the top of the ink metering roll 4 into a draining position B, as shown in dashed lines in FIG. 1. This means that the ink duct 1 is pivoted, in relation to a right-angled coordinate system with the origin on the axis of rotation 5 of the ink metering roller 4, from its work position A located in the I. or II. quadrants or in the I. and II. quadrants, in relation to the position of the doctor blades 11, 12 on the ink metering roller 4 into a draining position located in the I. and IV. quadrants or in the II. and III. quadrants in relation to the position of the doctor blades 11, 12. Thus, the ink duct 1 is pivoted out of a position, wherein the transverse axis 40 of the ink duct 1 extends horizontally or approximately horizontally, in such a way, that at the end of pivoting the transverse axis 40 of the ink duct 1 extends vertically or approximately vertically. In the process, the doctor blades 11 and 12 remain in contact with the circumference 2 of the ink metering roller 4. The pivot angle β of the ink duct 1 can lie between 70 and 110°. The pivot movement of the ink duct downward into the draining position B is limited, for example, by a stop 43 fixed in place on the lateral frame. The right lateral wall 7 of the ink duct 1 then rests against stop 43 and is held by it, or respectively is locked to it.

In the process, the ink 22 is collected in a channel 44, open at the top, of the lateral wall 7, which now is in a horizontal position, as shown in FIG. 1.

The ink duct 1 can be embodied to be easily removable, preferably from the press, in particular in the horizontal draining position B which is shown in dashed lines in FIG. 1. Ink duct 1 can be releasable and removable from the ends 28, 29 of the pivot arms 26, 27, or respectively from cross bar 20. For this purpose, the left lateral wall 6, for example, can be embodied to be guided by means of a linear guide 50 in the cross bar 20 and can be fixed in place.

Because the ink duct 1 can be removed from the press, the ink duct 1, as well as the ink metering roller 4, can be easily cleaned.

Pivoting of the ink duct 1 is not limited to the above described structure. It is also possible to pivot the ink duct 1 from the position A to the position B and back by other suitable mechanical means.

For example, the front walls 15, 17 could each be provided with stud bolts, wherein the stud bolts are guided in curved guides fixed on the lateral frames.

Figure 2:
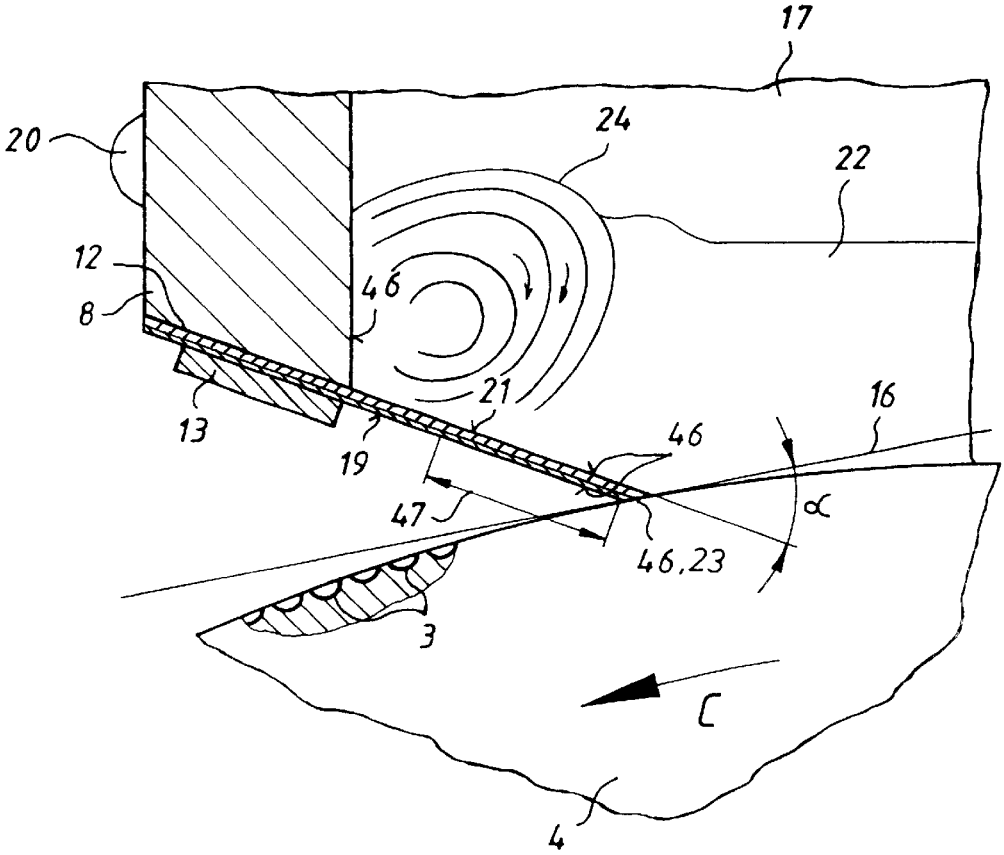

The ink metering elements 11, 12, are preferably embodied as doctor blades, however, they can also be continuous ink blades or also individual ink blade lamellas 46, as shown in FIG. 2. They are arranged and fastened on the underside of the ink duct 1. The doctor blades are used as working doctor blades 12 and/or as closing doctor blades 11.

While a preferred embodiment of an ink duct in accordance with the present invention has been set forth fullly and completely hereinabove, it will be apparent to one of skill in the art that a number of changes in, for example, the type of printing press with which the device is used, the surface configuration of the screen roller, and the like could be made without departing from the true spirit and scope of the present invention which is accordingly to be limited only the following claims.

What is claimed is:

1. An ink duct useable with an ink-metering roller comprising:

first and second ink metering elements on said ink duct, said first and second ink metering elements being spaced from each other and engageable with the ink-metering roller; and means supporting said ink duct for pivotable movement in relation to a right-angled coordinate system whose origin is an axis of rotation of the ink-metering roller, between a work position in the area of the I and II quadrants of the right-angle coordinate system and an ink draining position in the area of selectively a I and IV or a II and III quadrants of the right-angled coordinate system said ink duct adapted to maintain contact between at least one of said first and second ink metering elements and the ink-metering roller.

2. The ink duct of claim 1 wherein said first and second ink metering elements are adapted to be placed selectively positively and negatively in contact with the ink metering roller.

3. The ink duct of claim 1 wherein both said ink metering elements are adapted to be placed against the ink metering roller with the same angle of inclination.

4. The ink duct of claim 1 wherein said ink duct has a closed top which can be opened.

5. The ink duct of claim 1 further including first and second lateral walls, with at least one of said first and second lateral walls having a first partial lateral wall and a second partial lateral wall defining a channel, said channel opening toward an interior portion of said ink duct.

6. The ink duct of claim 1 further including pivot arms supporting said ink duct and wherein said ink duct is adapted to be removable from said pivot arms.

7. The ink duct of claim 1 wherein said first and second ink-metering elements are doctor blades.

8. The ink duct of claim 1 wherein said first and second ink metering elements are continuous doctor blades.

9. The ink duct of claim 1 wherein said first and second ink metering elements are individual ink blade lamellas.

10. An ink duct useable with an ink-metering roller comprising:

a working doctor blade and a closing doctor blade, said working doctor blade and said closing doctor blade being adapted to be positioned against the ink-metering roller; and means for supporting said ink duct for pivotable movement between a first position in which a transverse axis of said ink duct is horizontal, and a second position in which said transverse axis is vertical, at least one of said working and said closing doctor blades adapted to engage the ink-metering roller when said ink duct is in both said first and second positions.

11. The ink duct of claim 10 wherein said working doctor blade and said closing doctor blade are adapted to be placed selectively positively and negatively in contact with the ink metering roller.

12. The ink duct of claim 10 wherein both said working and closing doctor blades are adapted to be placed against the ink metering roller with the same angle of inclination.

13. The ink duct of claim 10 wherein said ink duct has a closed top which can be opened.

14. The ink duct of claim 10 further including first and second lateral walls, with at least one of said first and second lateral walls having a first partial lateral wall and a second partial lateral wall defining a channel, said channel opening toward an interior portion of said ink duct.

15. The ink duct of claim 10 further including pivot arms supporting said ink duct and wherein said ink duct is adapted to be removable from said pivot arms.

16. The ink duct of claim 10 wherein said working and closing doctor blades are continuous doctor blades.

17. The ink duct of claim 10 wherein said working and closing doctor blades are individual ink blade lamellas.

* * * * *